US010543521B2

(12) United States Patent
Yonemura et al.

(10) Patent No.: US 10,543,521 B2
(45) Date of Patent: Jan. 28, 2020

(54) PRESS FORMING METHOD AND VEHICLE COMPONENT

(71) Applicant: NIPPON STEEL & SUMITOMO METAL CORPORATION, Tokyo (JP)

(72) Inventors: Shigeru Yonemura, Tokyo (JP); Akihiro Uenishi, Tokyo (JP); Shin Toyokawa, Tokyo (JP); Takuya Kuwayama, Tokyo (JP); Takashi Ariga, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 546 days.

(21) Appl. No.: 15/340,823

(22) Filed: Nov. 1, 2016

(65) Prior Publication Data

US 2017/0056949 A1 Mar. 2, 2017

Related U.S. Application Data

(62) Division of application No. 14/117,681, filed as application No. PCT/JP2012/062522 on May 16, 2012, now Pat. No. 9,511,403.

(30) Foreign Application Priority Data

May 20, 2011 (JP) ..... 2011-113629
May 20, 2011 (JP) ..... 2011-113630

(51) Int. Cl.
*B21D 22/26* (2006.01)
*B21D 22/30* (2006.01)
(Continued)

(52) U.S. Cl.
CPC ..... *B21D 22/26* (2013.01); *B21D 22/30* (2013.01); *B21D 24/005* (2013.01); *B21D 35/006* (2013.01); *B21D 53/88* (2013.01)

(58) Field of Classification Search
CPC ..... B21D 22/02; B21D 22/04; B21D 22/20; B21D 22/21; B21D 22/22; B21D 22/225;
(Continued)

(56) References Cited

U.S. PATENT DOCUMENTS 8,573,023 B2 11/2013 Matsuda et al.
2007/0125149 A1 6/2007 Yoshitome et al.
(Continued)

FOREIGN PATENT DOCUMENTS

JP 61-082929 4/1986
JP 04-072010 3/1992
(Continued)

OTHER PUBLICATIONS

Final Office Action issued in U.S. Appl. No. 14/117,681 dated Nov. 9, 2015.
(Continued)

*Primary Examiner* — Peter Dungba Vo
*Assistant Examiner* — Joshua D Anderson
(74) *Attorney, Agent, or Firm* — Birch, Stewart, Kolasch & Birch, LLP

(57) ABSTRACT

Disclosed is a press forming method press forming a workpiece between a die and a punch, while pushing the punch into the die by means of a relative motion of the die and the punch, the method includes: producing an intermediate molding (100B) having ridges (100*d*) formed in predetermined parts of the workpiece, and then press forming the intermediate molding (100B) into a final shape, to thereby substantially thicken and work-harden the predetermined parts of the workpiece.

5 Claims, 14 Drawing Sheets

(51) Int. Cl.

| | |
|---|---|
| ***B21D 24/00*** | (2006.01) |
| ***B21D 35/00*** | (2006.01) |
| ***B21D 53/88*** | (2006.01) |

(58) Field of Classification Search
CPC ..... B21D 22/26; B21D 22/30; B21D 24/00; B21D 24/005; B21D 35/006; B21D 53/88
See application file for complete search history.

(56) References Cited

U.S. PATENT DOCUMENTS

| | | | | |
|---|---|---|---|---|
| 2008/0299352 | A1 | 12/2008 | Matsuda et al. | |
| 2010/0066106 | A1* | 3/2010 | Nojima ..... | B60R 19/18 293/120 |
| 2013/0061647 | A1 | 3/2013 | Matsuda et al. | |

FOREIGN PATENT DOCUMENTS

| | | |
|---|---|---|
| JP | 10-329503 | 12/1998 |
| JP | 2006-213941 | 8/2006 |
| JP | 2007-190588 | 8/2007 |
| JP | 2008-012570 | 1/2008 |
| JP | 2008-296252 | 12/2008 |
| JP | 2009-208149 | 9/2009 |
| JP | 2010-064137 | 3/2010 |
| JP | 2010-174283 | 8/2010 |
| JP | 2013027894 A | 2/2013 |

OTHER PUBLICATIONS

Non-Final Office Action issued in U.S. Appl. No. 14/117,681 dated Mar. 4, 2016.
Non-Final Office Action issued in U.S. Appl. No. 14/117,681 dated May 21, 2015.
Notice of Allowance issued in U.S. Appl. No. 14/117,681 dated Aug. 1, 2016.
International Preliminary Report on Patentability dated Nov. 28, 2013 issued in corresponding PCT Application No. PCT/JP2012/062522.
International Search Report dated Aug. 14, 2012 issued in corresponding PCT Application No. PCT/JP2012/062522 [with English translation].
Machine translation of JP2013-027894A from J-PLAT PAT detailed description.
Supplemental Notice of Allowance issued in U.S. Appl. No. 14/117,681 dated Aug. 15, 2016.

* cited by examiner

PRESS FORMING METHOD AND VEHICLE COMPONENT

This application is a Divisional of copending application Ser. No. 14/117,681, filed on Dec. 23, 2013, which was filed as PCT International Application No. PCT/JP2012/062522 filed on May 16, 2012, which claims the benefit under 35 U.S.C. §119(a) to Patent Application No. 2011-113629, filed in Japan on May 20, 2011 and Patent Application No. 2011-113630, filed in Japan on May 20, 2011, all of which are hereby expressly incorporated by reference into the present application.

TECHNICAL FIELD

The present invention relates to a press forming method and a vehicle component.

BACKGROUND ART

In recent years, improvement in vehicle fuel efficiency has been an urgent issue in the automobile industry, in view of reducing $CO_2$ emission causative of global warming. In addition to drastic efforts for reducing the $CO_2$ emission by using substitutive fuels, there are growing needs for measures such as improving mechanical efficiencies of engine, transmission and so forth, and reducing weight of vehicle body. On the other hand, in the situation directed to more tight crash safety regulations, another important issue is to develop a vehicle body excellent in vehicle safety performance.

It is however necessary to use a lot of reinforcing components or to thicken vehicle components, in order to improve the vehicle safety performance only by using low-strength steel sheet which configures vehicle bodies, so that it is not easy to harmonize the improvement with the light weight body.

For the purpose of harmonizing the light weight body and the improvement in vehicle safety performance, efforts have been made on use of high-strength steel sheet for vehicle components such as frame. For example, much of conventional vehicle components have been made of a steel sheet with a tensile strength of 440 MPa class, whereas recent vehicle components have increasingly adopted a steel sheet of 590 MPa class, and have become to adopt even a steel sheet of 980 MPa class or above.

The high-strength steel sheet has, however, encountered increased opportunities of shape fixation failure (spring-back) and wrinkle in the process of press forming (bending) as the strength of the steel sheet increases, gradually making it difficult to ensure dimensional accuracy of the vehicle components. In addition, decrease in ductility, accompanied by improved strength of the steel sheet, will increase a risk of breakage in the process of press forming.

It is therefore not always easy for the vehicle components composed of the high-strength steel sheet to harmonize performances and productivity of vehicle body, as compared with the conventional vehicle components making much use of the low-strength steel sheet, and this is understood as one of hindrances against use of the high-strength steel sheet for the vehicle components, under requirements of shortened period of development and reduction in manufacturing cost.

On the other hand, as methods of enhancing the crash safety performance of the vehicle components without using the high-strength steel sheet, there have been proposed methods of strengthening the entire portion of, or a part of the components, typically by hot press forming or induction hardening (see Patent Literatures 1, 2, for example). The methods are, however, applicable to a limited range of components, since some vehicle components are not suitable for the hardening due to their geometries, and also since some new equipment need be introduced.

Still another proposal relates to use of laser as a heat source of annealing (see Patent Literature 3, for example). The laser is, however, available only in a narrow range of heating, and therefore needs a long duration of annealing, which is not practical due to difficulty in obtaining a satisfactory effect.

CITATION LIST

Patent Literature

Patent Literature 1: Japanese Laid-Open Patent Publication No. 2010-174283

Patent Literature 2: Japanese Laid-Open Patent Publication No. 2006-213941

Patent Literature 3: Japanese Laid-Open Patent Publication No. H04-72010

Patent Literature 4: Japanese Laid-Open Patent Publication No. 2007-190588

Patent Literature 5: Japanese Laid-Open Patent Publication No. 2010-64137

Patent Literature 6: Japanese Laid-Open Patent Publication No. 2008-12570

Patent Literature 7: Japanese Laid-Open Patent Publication No. S61-82929

SUMMARY OF INVENTION

Technical Problem

Now a countermeasure for spring-back, which is a key element technology in this sort of forming process will be discussed. FIG. 12 is a drawing illustrating a generation mechanism of spring-back due to elastic strain recovery. When a tool component after completion of forming is relieved from load, typically by taking it out from the dies or trimming an unnecessary portion, the component is elastically deformed so as to satisfy a new balance, while being driven by a residual stress at the bottom dead center of press forming, and this appears as elastic strain recovery. The high-strength steel sheet shows large elastic strain recovery, and this makes it difficult to ensure dimensional accuracy required for the final product.

The shape fixation failure is classified by types of appearance which include angular change, side-wall curl, torsion, camber, and shape fixation failure of stamped bottom. In all cases, a residual stress distribution in the component acts as bending moment regarding bending and torsion, and causes the spring-back as a result of deformation determined by elastic modulus of the material or geometry of the component. A best known example relates to change in angle of bending (Patent Literature 4, Patent Literature 7, etc.). FIG. 13 is a drawing illustrating a relation between a stress distribution in the thickness-wise direction of sheet before elastic recovery, and bending moment. The recovery is driven by the strain distribution in the direction of sheet thickness ($t_0$), and rigidity of the component in this case is mainly determined by the geometry thereof.

In other exemplary cases where longitudinally curved beams with a hat-like cross section caused side-wall curl and torsion (Patent Literature 2, Patent Literature 6, etc.) after draw forming, it is known that the components are increased in the rigidity and thereby reduced in the side-wall curl when the radius of curvature of bending is small, and that difference in stress between an stretched flange portion and a shrunk flange portion gives torsional moment. They are methods of press forming capable of leveling (at a low level) the residual stress distribution, and thereby reducing the motive force (moment) depending on the mode of spring-back. All of the methods described in Patent Literatures 4 to 7 are based on this sort of technical spirit.

Next, the press forming methods disclosed in Patent Literatures 4 to 7, capable of ensuring good levels of shape fixation performance, will be explained. Magnitude of spring-back depends on flow stress (residual stress) immediately before release of constraint (mold releasing). In other words, since the motive force of spring-back is mainly due to the moment ascribable to the uneven stress distribution, so that techniques based on various processes, such as those described in Patent Literatures 1 and 7, of reducing the difference of residual stress in the thickness-wise direction of sheet have been proposed.

All of these techniques relate to press forming process composed of a plurality of steps and are referred to as methods of controlling history of deformation, based on reduction in the residual stress distribution by final strain increment which accumulates over a period towards the bottom dead center of press forming, in the final step for obtaining the product shape. FIG. 14 is a drawing for explaining a mechanism of reducing the residual stress by the countermeasure addressing the shape fixability. In the method of controlling history of deformation, elastic strain recovery is reduced by controlling residual stress in the second step (mold releasing).

For another case where three dimensional spring-back occurs typically in the form of torsion, camber or the like (Patent Literature 5, Patent Literature 6, etc.), a method of controlling history of in-plane deformation is used to apply compressive stress to a stretched portion immediately in front of the bottom dead center in the final step, and to apply tensile stress to the shrunk portion. For this purpose, there has been proposed a method of controlling the in-plane stress distribution, by providing embossment or bead to the product to thereby convert the compressive stress to the tensile stress, or by squashing the thus-provided embossment or bead prior to the final step, to thereby convert the tensile stress to the compressive stress.

The countermeasures for spring-back may, however, be excessive to cause so-called "spring-go (spring-in)" if the residual stress is miscontrolled, so that it is necessary to suppress the stress to be introduced in the second step to a level only enough to reduce the residual stress (see FIG. 14). If a stress exceeding the level described above is applied in the second step, the spring-back will conversely increase, since the flow stress immediately before the mold releasing (residual stress) increases. For this reason, the method of using dies with different radii of curvature as described in Patent Literature 4, and the method of using convex embossment as described in Patent Literature 7, are not able to give a large work hardening in the final step, due to the restrictions described above.

The present invention was conceived in consideration of the conventional situation, an object of which is to provide a press forming method capable of enhancing deformation strength of a workpiece, by repeating press forming a plurality of times, without subjecting the workpiece to any types of annealing such as hot press forming or induction hardening; and a vehicle component with an excellent vehicle safety performance, which is successfully improved in rate of absorption of externally applied impact energy, by using a workpiece after being molded according to such press forming method.

Solution to Problem

Summary of the present invention, directed to solve the above-described problems, is as follows.

(1) A press forming method press forming a workpiece between a die and a punch, while pushing the punch into the die by means of a relative motion of the die and the punch, the method includes:

producing an intermediate molding having a ridge formed in a predetermined part of the workpiece, and then press forming the intermediate molding into a final shape, to thereby substantially thicken and work-harden the predetermined part of the workpiece.

(2) The press forming method of (1), wherein the intermediate molding, produced from the workpiece, is repetitively stamped at least once or more so as to shape the workpiece into the final shape, to thereby work-harden the bent predetermined part of the workpiece.

(3) The press forming method of (2), wherein the ridge is located to an angular part of the intermediate molding of the workpiece.

(4) The press forming method of (2), wherein the intermediate molding, produced from the workpiece so as to have an intermediate shape with a section line length 2% or more larger than the section line length of the final shape, is repetitively stamped at least once or more, to thereby shape the workpiece into the final shape.

(5) The press forming method of (2), wherein the intermediate molding, produced from the workpiece so as to have an intermediate shape with a section line length 1 mm or more longer than the section line length of the final shape, is repetitively stamped at least once or more, to thereby shape the workpiece into the final shape.

(6) The press forming method of (2), wherein the intermediate molding, produced from the workpiece so as to have an intermediate shape with a radius of the ridge section 1 mm or more smaller than the radius of the ridge section of the final shape, is repetitively stamped at least once or more, to thereby shape the workpiece into the final shape.

(7) The press forming method of (1), which includes:

forming the ridge in a predetermined part of the workpiece; and flattening and thickening the part having the ridge provided therein, to thereby work-harden the part.

(8) The press forming method of (7), wherein the ridge is located to the ceiling of the intermediate molding of the workpiece.

(9) The press forming method of (7), which includes:

producing the intermediate molding having the ridge provided to the workpiece, and then press forming the intermediate molding to thereby flatten the part having the ridge provided therein between the die and the punch.

(10) The press forming method of (7), which includes:

producing the intermediate molding having the ridge provided to the workpiece, after or at the same time with press forming of the workpiece, and then press forming the intermediate molding to thereby flatten the part having the ridge provided therein between the die and the punch.

(11) The press forming method of (7), wherein the intermediate molding, produced from the workpiece so as to have an intermediate shape with a section line length 2% or more larger than the section line length of the final shape, is repetitively stamped at least once or more, to thereby shape the workpiece into the final shape.

(12) A vehicle component capable of absorbing externally applied impact energy by buckling deformation, the vehicle component contains a workpiece molded by the press forming method described in any one of (1) to (10).

(13) The vehicle component of (12), wherein the workpiece has a hat-like cross sectional shape, and a ridge formed in the bent workpiece is work-hardened and thereby has a deformation strength larger than that of the other parts.

Advantageous Effects of Invention

According to the present invention, by producing the intermediate molding having the ridge formed in a predetermined part of the workpiece, and then press forming the intermediate molding into a final shape, to thereby substantially thicken and work-harden the predetermined part of the workpiece as described above, it is now possible to enhance deformation strength of the work-hardened ridge, without subjecting the workpiece to any types of annealing such as hot press forming or induction hardening. The vehicle component which contains the workpiece is now successfully enhanced in the rate of absorption of externally applied impact energy.

DESCRIPTION OF EMBODIMENTS

The press forming method and the vehicle component applied with the present invention will be detailed referring to the attached drawings.

Note that, in some cases, the drawings referred to in the description below only schematically illustrate the workpieces and press forming apparatuses for the convenience sake, so that the dimensional proportion of the individual parts is not always same as the actual one. Also note that the dimensions and so forth exemplified in the description below are merely illustrative ones. The present invention is not always limited thereto, and may be implemented without departing from the spirit thereof.

In a first embodiment of the present invention, the press forming method of the present invention will be explained specifically referring, for example, to a stamped product (vehicle component) 100A having the hat-like cross sectional shape illustrated in FIG. 1.

Figure 1:
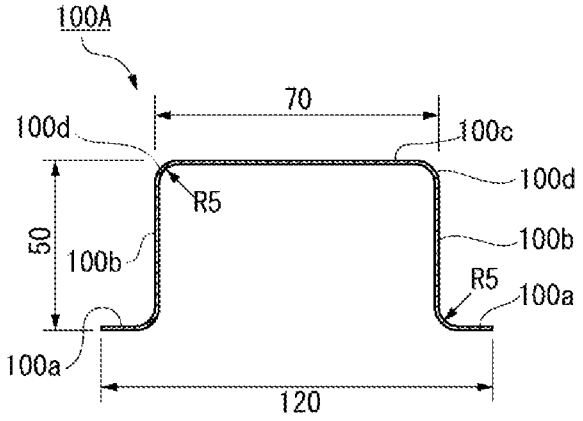
FIG. 1 is a drawing illustrating an exemplary stamped product having a hat-like cross sectional shape in a first embodiment of the present invention.

The stamped product 100A has, as illustrated in FIG. 1, a hat-like cross sectional shape formed by subjecting a sheet metal (workpiece) 100 to draw bending (press forming) into a final shape having pairs of flanges 100*a* and vertical walls 100*b*, and a ceiling 100*c*. FIG. 1 also shows exemplary dimensions (in millimeters) of these parts of the stamped product 100A.

Figure 2A:
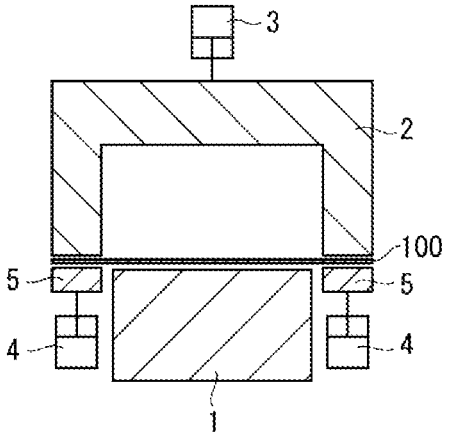
FIG. 2A is a drawing for explaining an operation of a press forming apparatus used in the present invention.
Figure 2B:
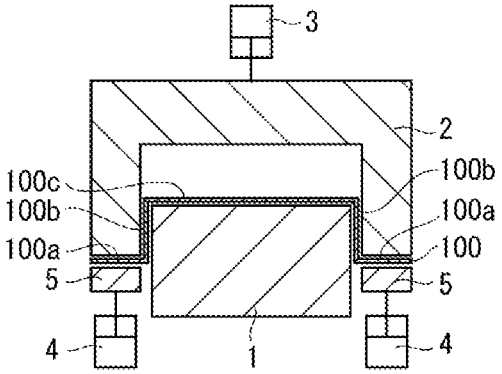
FIG. 2B is a drawing for explaining an operation of the press forming apparatus used in the present invention.

FIG. 2A and FIG. 2B are drawings schematically illustrating an exemplary press forming apparatus. The press forming apparatus has a punch 1 attached to a lower holder (stationary holder), and a die 2 attached to an upper holder (moving holder), and is configured to bring up or down the die 2 attached with a gas cylinder 3 ("down" in FIG. 2A and FIG. 2B) so as to push the punch 1 into the die 2, to thereby stamp the sheet metal 100 between the die 2 and the punch 1.

The press forming apparatus has a pair of blank holders 5 each of which being attached with an independent gas cylinder 4, and is configured to bring up or down the blank holders 5 ("up" in FIG. 2A and FIG. 2B) so as to implement draw bending, according to which the punch 1 is pushed into the die 2 for press forming, while clamping the edge portions of the sheet metal 100 (flanges 100*a* of the stamped product 100A illustrated in FIG. 1) between the blank holders 5 and the die 2 under fold pressure (tension).

Note that the present invention is not limited to the draw bending, and is also applicable to form bending according to which the metal sheet is stamped without being applied with the fold pressure (tension). While the press forming apparatus shown above is configured to move the die 2 towards the punch 1, it may alternatively be configured to move the punch 1 towards the die 2. Another possible configuration is such that the die 2 is attached to the lower holder, and the punch 1 is attached to the upper holder.

Now, an exemplary case of press forming of the sheet metal 100 according to a conventional press forming method will be described. First, as illustrated in FIG. 2A, the sheet metal 100 is set on the press forming apparatus, and the die 2 is brought down, achieving a state that the edge portions of the sheet metal 100, or the flanges 100*a*, are held between the blank holders 5 and the die 2. The fold pressure of the blank holders 5 applied to the sheet metal 100 herein is controlled by adjusting pressure of the gas cylinders 4.

Next, as illustrated in FIG. 2B, the die 2 is further brought down from this state, thereby the punch 1 is kept pressed in the die 2. In this event, since the edge portions (flanges 100*a*) of the sheet metal 100 are applied with the fold pressure (tension) by the blank holders 5, so that portions not constrained by the blank holders 5 and the punch 1 (vertical walls 100*b* of the stamped product 100A illustrated in FIG. 1) are thinned due to plastic deformation, and work-hardened.

The die 2 further descends from this state down to the bottom dead center of the press forming process, and thereby the sheet metal 100 is stamped between the punch 1 and the die 2. In this way, the stamped product (vehicle component) 100A having the hat-like cross sectional shape illustrated in FIG. 1 may be obtained.

According to such conventional press forming method, the sheet metal 100 will be work-hardened in the vertical walls 100*b*, and this means while the vertical walls 100*b* might be enhanced in the deformation strength, the vertical walls 100*b* will be thinned at the same time. The obtained stamped product (vehicle component) 100A was, therefore, improved in the rate of absorption of externally applied impact energy but not so much as expected, proving it difficult to improve the crash safety performance.

Another known method is such as press forming the sheet metal 100 by form bending, without using the blank holders 5, and therefore applying no fold pressure (tension). The sheet metal 100 in this case, however, causes the work hardening neither in the ridge where the metal sheet 100 was bent, nor in the region other than the ridge, again proving it difficult to enhance the rate of absorption of externally applied impact energy.

The present inventors then conducted thorough investigations to address the problems above, and found out a press forming method based on a plurality of times of press forming, which is capable of introducing a large work hardening into a bent ridge of a vehicle component such as vehicle frame, without decreasing the sheet thickness, and also found that a vehicle component, which makes a wise use of such work hardening, could be improved largely in the rate of absorption of impact energy externally applied in case of collision or the like. The findings led us to propose the present invention.

According to the present invention, there is provided a press forming method press forming a workpiece between a die and a punch, while pushing the punch into the die by means of a relative motion of the die and the punch. The method characteristically includes producing an intermediate molding having a ridge formed in a predetermined part of the workpiece (in this embodiment, portions corresponded to angular parts between the vertical walls 100*b* and the ceiling 100*c* as described later), and then press forming the intermediate molding into a final shape, to thereby substantially thicken and work-harden the predetermined part of the workpiece.

According to the method of the present invention, the sheet metal is subjected to draw bending or bending to produce the intermediate product having a section line length larger than that of the final product, and the ridge is re-shaped into the product geometry, immediately in front of the bottom dead center of the succeeding press forming process. In this second step of press forming, the ridge undergoes compressive plastic deformation, and thereby a large work hardening may be introduced without reducing the thickness. In this case, the intermediate molding is produced from the metal sheet so as to have a large cross sectional profile with a ratio of line length 2% or more larger and 10% or smaller, than that of the final product geometry, and is further stamped into a cross sectional profile of the final product geometry.

The reason why the cross sectional profile was determined as described above is that yield point elongation is observed for some materials, so that if the ratio is smaller than 2%, the work hardening may be insufficient and an expected level of deformation strength is not always attainable. On the other hand, the reason why the ratio of section line length was determined as 10% or smaller is that, if the ratio exceeds the value, folds ascribable to an extra material may occur in the second step, enough to prevent production of good moldings. In particular, in the general press forming, a thin sheet undergoes compressive deformation only with difficulty due to buckling as described above. The present inventors now made it possible to give compressive deformation by combining an optimal ratio of lengths in the first step and the second step, with the ratio of widths of a pad and the punch.

Figure 3A:
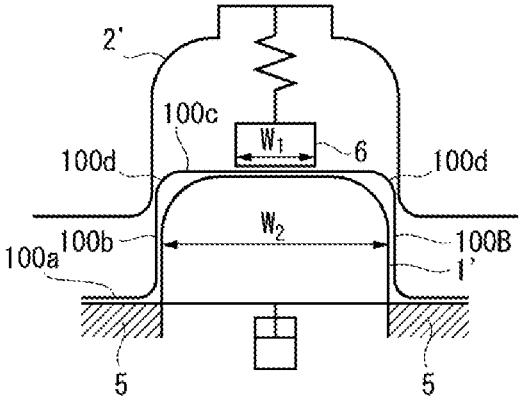
FIG. 3A is a drawing for explaining an operation of the second step in a press forming apparatus used in the first embodiment of the present invention.
Figure 3B:
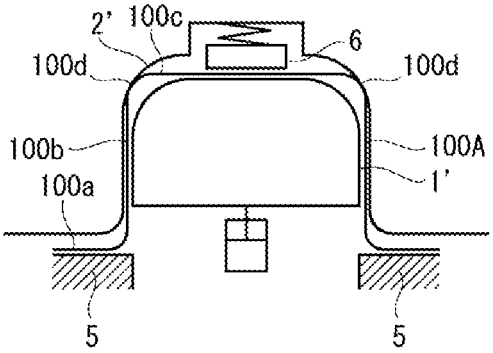
FIG. 3B is a drawing for explaining an operation of the second step in a press forming apparatus used in the first embodiment of the present invention.

FIG. 3A and FIG. 3B are drawings schematically illustrating an exemplary press forming apparatus used in the second step. The press forming apparatus is roughly configured by a punch 1' attached to a lower holder, a die 2' supported by an upper holder, and a pad 6 supported by the upper holder. In the thus-configured press forming apparatus, first, an intermediate molding 100B is held between the punch 1' and the pad 6 as illustrated in FIG. 3A. Under a controlled pressing force of the pad 6 regulated by a gas cylinder, the die 2' descends to the bottom dead center as illustrated in FIG. 3B, to thereby give the product geometry. Since the intermediate molding 100E in this case is constrained by the pad 6 and the material thereof is kept immobilized, so that the ridges are compressively deformed in an efficient manner.

In the case described above, magnitude and region of the compressive deformation of the ridges will vary, depending on ratio of width $W_1$ of the pad 6 relative to width $W_2$ of the punch 1'. More specifically, if the ratio of widths $W_1/W_2$ of the pad 6 and the punch 1' is close to 1, only the ridges may be introduced with a large work hardening, but a risk of folds due to bucking may increase. Therefore, the ratio of widths $W_1/W_2$ of the pad 6 and the punch 1' is preferably 0.8 or smaller. In contrast, if the ratio of widths becomes small, a wide region centered round the ridge may be work-hardened. From the viewpoint of effective work hardening of the ridge, the ratio of widths $W_1/W_2$ is preferably adjusted to 0.4 or larger.

The press forming method of the present invention will now be explained more specifically. In the first step, the sheet metal 100 is stamped using the press forming apparatus illustrated in FIG. 2A and FIG. 2B. By the press forming in the first step, the intermediate molding 100B is manufactured so as to have a hat-like cross sectional shape (intermediate shape) indicated by a broken line in FIG. 4.

Figure 4:
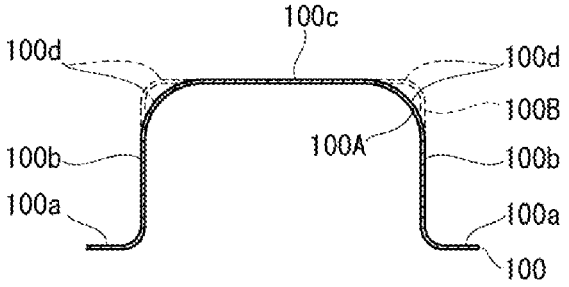
FIG. 4 is a drawing illustrating an exemplary stamped product formed by the press forming method of the present invention.

The intermediate molding 100B has a section line length longer than that of the stamped product 100A having the hat-like cross sectional shape (final shape) illustrated in FIG. 1 (indicated by a solid line in FIG. 4).

Then in the second step, the intermediate molding 100B is stamped as described above, into the hat-like cross sectional shape (final shape) as illustrated by the solid line in FIG. 4.

Figure 5:
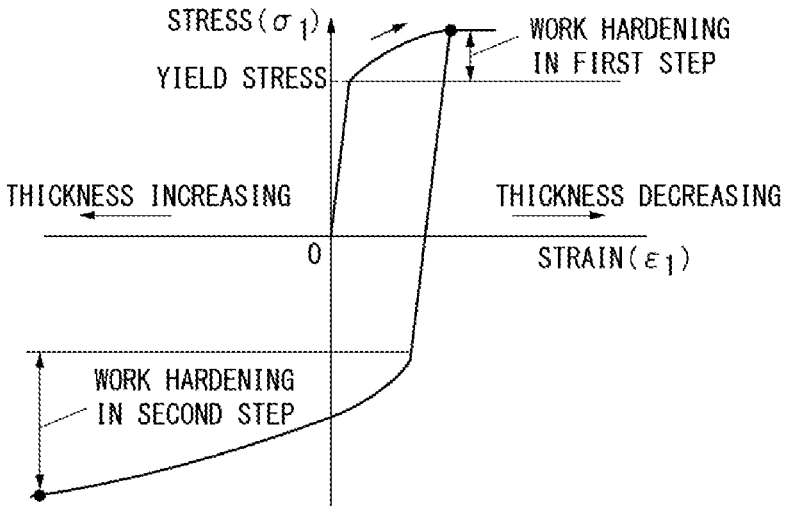
FIG. 5 is a drawing illustrating a mechanism of work hardening which proceeds in a material during the press forming method of the present invention.

Now in the present invention, in the first step of press forming, the sheet metal 100 is introduced with plastic deformation by bending as indicated by the broken line in FIG. 4, whereas in the second step of press forming, compressive plastic deformation occurs in ridges 100*d* between the ceiling 100*c* and the vertical walls 100*b* of the bent sheet metal 100 as indicated by the solid line in FIG. 4. As a consequence, as illustrated in FIG. 5, the sheet metal 100 may be work-hardened to a large degree, by substantially thickening the ridges 100*d* in the second step of press forming.

In the present invention, the sheet metal 100 is preferably shaped into the final shape (stamped product 100A), by repetitively, at least once or more, press forming the intermediate molding 100B which is produced from the sheet metal 100 so as to have an intermediate shape with a section line length 2% or more larger than the section line length of the final shape. This is because yield point elongation is observed for some materials, so that if the ratio is smaller than 2%, the work hardening may be insufficient and an expected level of deformation strength is not always attainable.

In the present invention, the sheet metal 100 is also preferably shaped into the final shape (stamped product 100A), by repetitively, at least once or more, press forming the intermediate molding 100B which is produced so as to have an intermediate shape with a section line length 1 mm or more longer than the section line length of the final shape, or the intermediate molding 100B which is produced so as to have an intermediate shape with a radius of the ridge section 1 mm or more smaller than the radius of the ridge section of the final shape.

According to the present invention, it is now possible to enhance deformation strength of the ridges 100*d* which are substantially thickened and work-hardened, without subjecting the sheet metal 100 to any types of annealing such as hot press forming or induction hardening.

In this way, the stamped product 100A (vehicle component) having the hat-like cross sectional shape (final shape) illustrated in FIG. 1, may be obtained.

The thus-obtained stamped product 100A may successfully be used as a vehicle component capable of absorbing externally applied impact energy by buckling deformation. More specifically, the vehicle component is composed of the stamped product 100A having the hat-like cross sectional shape, in which the bent ridges 100*d* are thickened and work-hardened, and thereby the ridges 100*d* have a deformation strength much larger than that of the other parts. Accordingly, it is now possible to largely increase the rate of absorption of externally applied impact energy in case of collision or the like.

It is therefore concluded that, according to the present invention, automotive structural components (vehicle components) such as front frame, side sill outer and so forth, may be work-hardened in a predetermined part thereof, basically by means of the conventional cold press forming, without introducing any new facilities for hot press forming or hardening such as induction hardening, and may thereby be enhanced in the collision strength. In addition, the components may be thinned without degrading the crash safety performance. It is also possible to provide automotive structural components (vehicle components) which satisfy both of reduction in vehicle weight and improvement in the crash safety performance, while suppressing the manufacturing cost from excessively increasing.

EXAMPLE 1

The effects of the present invention will further be clarified below referring to Example. Note that the present invention is not limited to Example below, and may be implemented in an appropriately modified manner without departing from the spirit thereof.

In this Example, a 590-MPa-class dual phase steel sheet of 1.2 mm thick was prepared as the sheet metal 100, the steel sheet was stamped in the first step into the intermediate shape (intermediate molding), and the intermediate molding was stamped in the second step into the final shape, to thereby manufacture the stamped product having the hat-like cross sectional shape illustrated in FIG. 1. In the first step of press forming, the press forming was conducted while setting the radius R of the stamped shoulder of the intermediate shape (intermediate molding) 1 mm smaller than that of the final shape (stamped product).

Figure 6:
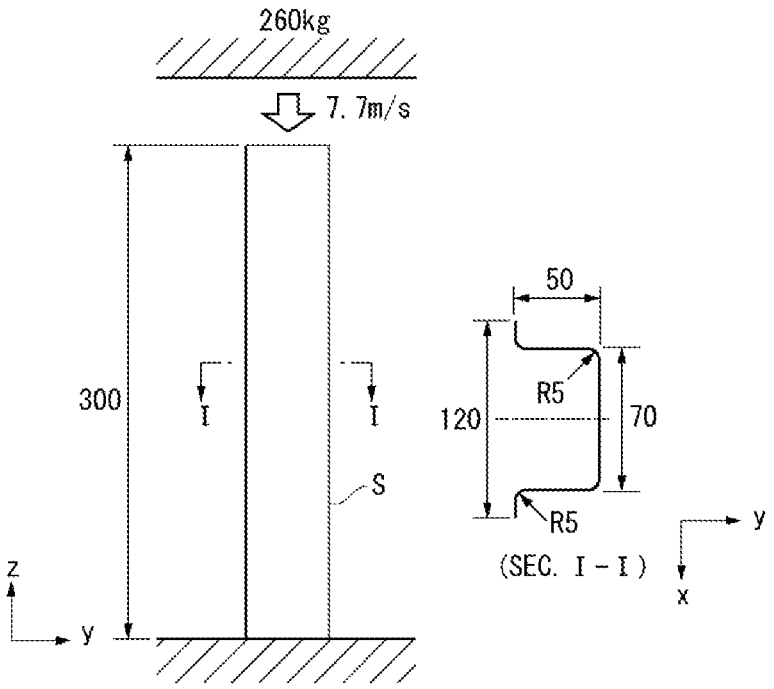
FIG. 6 is a drawing illustrating the individual dimensions of a sample piece manufactured in Example of the present invention.

The thus-manufactured stamped product having the hat-like cross sectional shape was butted with a parallel flat closing plate, and spot-welded on the flanges at 30 mm pitch, to thereby obtain a sample piece S having the individual dimensions as illustrated in FIG. 6.

The sample piece S of the present invention was subjected to a falling weight test in which a 260 kg weight was allowed to freely fall from a height of 3 m, and allowed to collide at an initial velocity of 7.7 m/s. Reaction force to material deformation was measured using a load cell attached to the fixed end side, and displacement was measured using a laser displacement meter.

In order to further confirm the effects of the present invention, also a stamped product manufactured by the conventional press forming method explained referring to FIG. 2, was comparatively studied. Also the sample piece of Comparative Example was subjected to the similar falling weight test.

Figure 7:
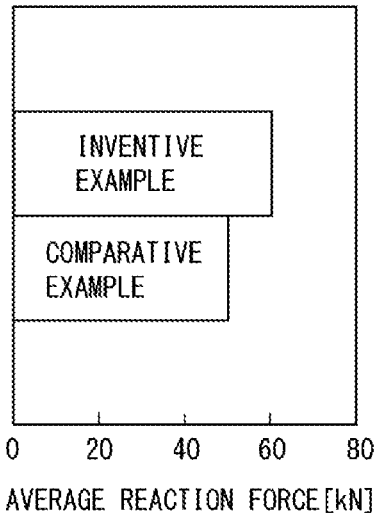
FIG. 7 is a graph comparatively illustrating energy absorption by a sample piece of the present invention and a sample piece of Comparative Example under stroke of a falling weight test.

Results of energy absorption by the sample pieces according to Example of the present invention and Comparative Example, calculated by integrating the reaction force to deformation over stroke, are comparatively shown in FIG. 7.

As illustrated in FIG. 7, according to the present invention, the energy absorption by the component was found to increase by approximately 10%, by introducing a large work hardening into the steel sheet without reducing the thickness.

Next, a second embodiment of the press forming method and vehicle component according to the present invention will be explained. Note that all components identical or corresponded to those described previously in the first embodiment will be explained appropriately using the same reference numerals.

Also in the second embodiment, an exemplary case of obtaining the stamped product 100A (vehicle component), having the hat-like cross sectional shape previously illustrated in FIG. 1, will be explained.

The stamped product 100A therefore has, as a result of draw bending (press forming) of the sheet metal (workpiece) 100, the final shape characterized by the hat-like cross sectional shape having the pairs of flanges 100*a* and the vertical walls 100*b*, and the ceiling 100*c*.

If the sheet metal is stamped by the conventional press forming method using the press forming apparatus illustrated in FIG. 2 in order to obtain the stamped product 100A, the obtainable stamped product (vehicle component) 100A is improved in the rate of absorption of externally applied impact energy, but not so much as expected, proving it difficult to improve the crash safety performance, as described previously in the first embodiment.

Another known method is such as press forming the sheet metal 100 by form bending, without using the blank holders 5, and therefore applying no fold pressure (tension). The sheet metal 100 in this case is, however, work-hardened neither in the ridge where the metal sheet 100 was bent, nor in the region other than the ridge, again proving it difficult to enhance the rate of absorption of externally applied impact energy.

Accordingly in the second embodiment of the present invention, there is provided a press forming method press forming a workpiece between a die and a punch, while pushing the punch into the die by means of a relative motion of the die and the punch. The method characteristically includes producing an intermediate molding having the ridges formed in a predetermined part of the workpiece (in this embodiment, a portion corresponded to the ceiling 100*c* as described later), and then press forming the intermediate molding into a final shape, to thereby substantially thicken and work-harden the predetermined part of the workpiece.

In particular, the press forming method of the second embodiment includes a step of forming the ridges in a predetermined part of the workpiece, and a step of flattening and thickening, and thereby work-hardening the part having the ridges provided therein.

The press forming method according to the second embodiment of the present invention will be explained more specifically. In the first step, the sheet metal 100 is stamped using a press forming apparatus illustrated in FIG. 8, while embossing predetermined parts of the sheet metal 100.

The press forming apparatus used for embossing in the first step is roughly configured by a punch 11 having projections 11*a* and attached to a lower holder, and a die 12 having recesses 12*a* and attached to an upper holder. By bringing up or down ("down" in FIG. 8) the die 12 attached with the gas cylinder 3 so as to push the projections 11*a* of the punch 11 into the recesses 12*a* of the die 12, the sheet metal 100 is embossed. In this way, the intermediate molding 100B, having an intermediate shape characterized by a plurality of embossments (irregularities) B formed in the center portion of the sheet metal 100 (the ceiling 100*c* of the stamped product 100A illustrated in FIG. 1), is produced.

Figure 8:
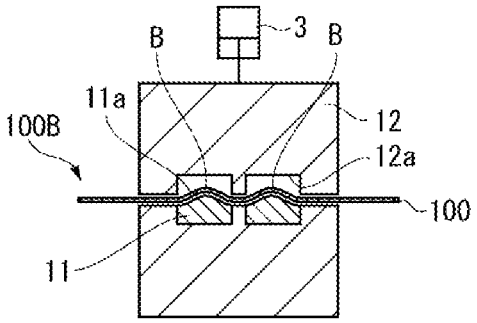
FIG. 8 is a drawing for explaining an operation of a press forming apparatus used in a second embodiment of the present invention.

In the second embodiment, as illustrated in FIG. 8, the embossments B as the ridges are located to the ceiling 100*c*. The embossments B have a convex curve as illustrated in FIG. 8, just looking like ridges.

Note that while FIG. 8 illustrates an exemplary case where two embossments B are formed on the intermediate molding 100B, the number of embossments B formed on the intermediate molding 100B is not specifically limited, and the geometry and number thereof may appropriately be modified.

Next, the thus-embossed sheet metal 100 (intermediate molding 100B) is stamped in the second step, using the press forming apparatus illustrated in FIG. 2. In this way, the stamped product (vehicle component) 100A having the hat-like cross sectional shape illustrated in FIG. 1 may be obtained.

Figure 9A:
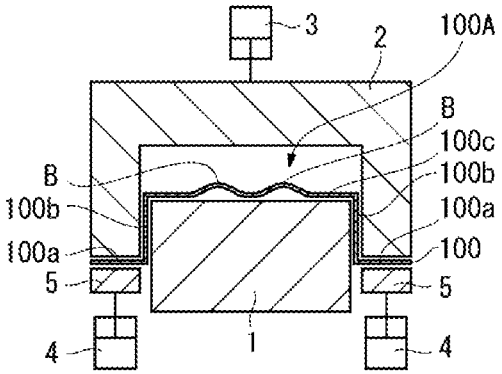
FIG. 9A is a drawing for explaining an operation of a press forming apparatus used in the second embodiment of the present invention.

More specifically, as illustrated in FIG. 9A, when the intermediate molding 100B is set on the press forming apparatus (FIG. 2), and the die 2 is brought down, the flanges 100*a* of the sheet metal 100 are held between the blank holders 5 and the die 2. With the aid of pressure regulated by the gas cylinders 4, fold pressure of the blank holders 5 exerted on the flanges 100*a* is controlled.

The die 2 further descends from this state so as to push the punch 1 into the die 2. In this process, since the flanges 100*a* are held under the fold pressure (tension) by the blank holders 5, so that the vertical walls 100*b* of the sheet metal 100 which are not constrained by the blank holders 5 and the punch 1 are thinned by plastic deformation, and work-hardened.

Figure 9B:
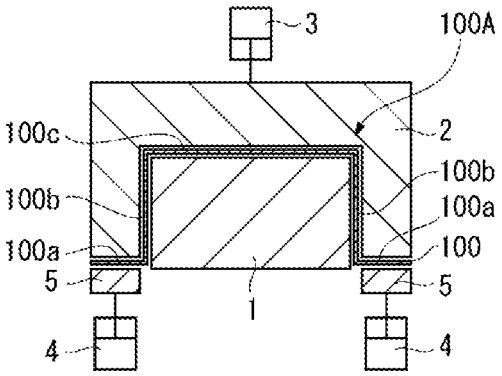
FIG. 9B is a drawing for explaining an operation of the press forming apparatus used in the second embodiment of the present invention.

Then as illustrated in FIG. 9B, the die 2 further descends from this state down to the bottom dead center, and thereby the sheet metal 100 is stamped between the punch 1 and the die 2. In this process, the embossments B are squashed between the punch 1 and the die 2, and thereby the ceiling 100*c* of the sheet metal 100 is flattened.

In this way, the ceiling 100*c* of the sheet metal 100, which is the portion corresponded to the ridge in this example, may be work-hardened. More specifically, the sheet metal 100 is introduced with plastic deformation by bulging in the process of embossing, on the other hand, introduced with compressive plastic deformation in the process of press forming as a result of squashing of the embossments B. As a consequence, the sheet metal 100 may substantially be thickened at around the embossments B by the press forming in the second step, and is thereby introduced with a large work hardening.

According to the present invention, the work-hardened part described above may be enhanced in the deformation strength, without subjecting the sheet metal 100 to any types of annealing such as hot press forming or induction hardening.

The thus-obtained stamped product 100A may successfully be used as a vehicle component capable of absorbing externally applied impact energy by buckling deformation. More specifically, the vehicle component is composed of the stamped product 100A having the hat-like cross sectional shape, in which a predetermined part in the longitudinal or width-wise direction thereof is work-hardened, and thereby the part has a deformation strength much larger than that of the other parts. Accordingly, it is now possible to largely increase the rate of absorption of externally applied impact energy in case of collision or the like.

It is therefore concluded that, according to the present invention, automotive structural components (vehicle components) such as front frame, side sill outer and so forth, may be work-hardened in a predetermined part thereof, basically by means of the conventional cold press forming, without introducing any new facilities for hot press forming or hardening such as induction hardening, and may thereby be enhanced in the collision strength. In addition, the components may be thinned without degrading the crash safety performance. It is also possible to provide automotive structural components (vehicle components) which satisfy both of reduction in vehicle weight and improvement in the crash safety performance, while suppressing the manufacturing cost from excessively increasing.

The present invention is not always limited to the embodiments described above, and may be modified in various ways without departing from the spirit thereof.

For example, the second embodiment described above dealt with the case where the sheet metal (workpiece) 100 was embossed to produce the intermediate molding 100B, and the intermediate molding 100B was then stamped so as to flatten the embossed part. It is alternatively possible in the present invention to produce the intermediate molding by embossing the sheet metal 100, after completion of, or at the same time with the press forming of the sheet metal 100, and then to stamp the intermediate molding to thereby flatten the embossed part. Also in this case, the effects same as those in the above-described embodiments may be obtained.

Figure 10:
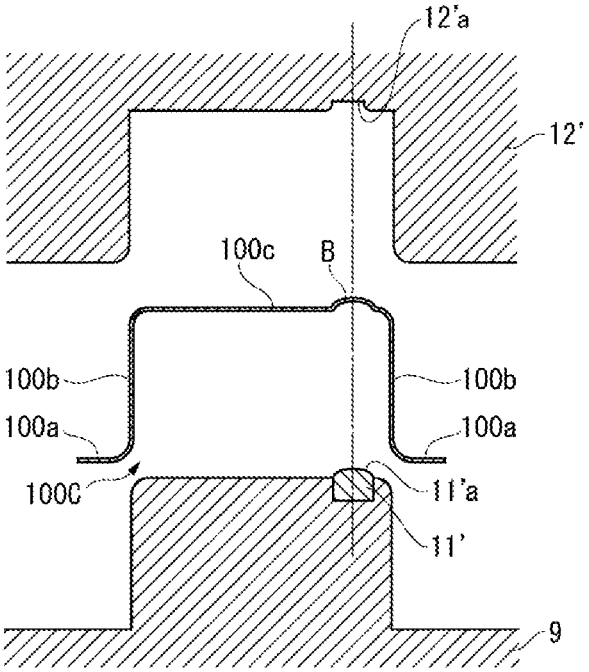
FIG. 10 is a drawing for explaining an operation of a press forming apparatus used in a modified example of the second embodiment of the present invention.

For example, using a press forming apparatus illustrated in FIG. 10, the sheet metal 100 is stamped to produce an intermediate molding 100C having an intermediate shape characterized by the embossments provided to the sheet metal 100. The press forming apparatus is roughly configured by a punch 11' having projections 11'*a* and attached to a lower holder, and a die 12' having recesses 12'*a* and attached to an upper holder.

By bringing up or down ("down" in FIG. 10) the die 12' attached with a gas cylinder (not illustrated), the sheet metal 100 is stamped as the punch 11' is pushed into the die 12', and the sheet metal 100 is concomitantly embossed on the ceiling 100*c* thereof as the projections 11'*a* are pushed into the recesses 12'*a*. In this way, the intermediate molding 100C, having a plurality of embossments (irregularities) B formed on the ceiling 100*c* of the sheet metal 100, is produced.

Next, using the press forming apparatus illustrated in FIG. 2, the thus-embossed sheet metal 100 (intermediate molding 100C) is stamped. In this way, the stamped product (vehicle component) 100A having the hat-like cross sectional shape illustrated in FIG. 1 may be obtained.

According to the present invention, by press forming the embossed sheet metal 100 (intermediate molding 100C), the part embossed between the die 2 and the punch 1 is flattened similarly to the case of press forming of the intermediate molding 100B, and thereby the part may be work-hardened.

According to the present invention, the sheet metal 100 may be enhanced in the deformation strength specifically in the part substantially thickened and work-hardened as described above, without subjecting the sheet metal 100 to any types of annealing such as hot press forming or induction hardening.

In the present invention, the sheet metal 100 is preferably shaped into the final shape (stamped product 100A), by repetitively, at least once or more, press forming the intermediate molding 100B or 100C which is produced from the sheet metal 100 so as to have an intermediate shape with a section line length 2% or more larger than the section line length of the final shape. This is because yield point elongation is observed for some materials, so that if the ratio is smaller than 2%, the work hardening may be insufficient and an expected level of deformation strength is not always attainable.

EXAMPLE 2

The effects of the present invention will be more clarified below referring to Example. Note that the present invention is not limited to Example below, and may be implemented in an appropriately modified manner without departing from the spirit thereof.

In this Example, a 590-MPa-class dual phase steel sheet of 1.2 mm thick was prepared as the sheet metal 100, and the steel sheet was stamped by a press forming method of the present invention illustrated in FIG. 8, FIG. 9A and FIG. 9B, thereby the stamped product having the hat-like cross sectional shape illustrated in FIG. 1 was manufactured.

In the first step illustrated in FIG. 8, embossments of 10 mm in diameter and 3 mm in height were provided so as to align two in the width-wise direction and 30 in the longitudinal direction. In the second step illustrated in FIG. 9A and FIG. 9B, all of the embossments were squashed and flattened.

The thus-manufactured stamped product having the hat-like cross sectional shape was butted with a parallel flat closing plate, and spot-welded on the flanges at 30 mm pitch, to thereby obtain a sample piece S having the individual dimensions illustrated in FIG. 6, as explained previously in the first embodiment.

Referring now to FIG. 6, the sample piece S of the present invention was subjected to a falling weight test in which a 260 kg weight was allowed to freely fall from a height of 3 m, and allowed to collide at an initial velocity of 7.7 m/s. Reaction force to material deformation was measured using a load cell attached to the fixed end side, and displacement was measured using a laser displacement meter.

In order to further confirm the effects of the present invention, also a sample piece of Comparative Example, using a stamped product manufactured by the conventional press forming method explained referring to FIG. 2, was studied by the similar falling weight test.

Figure 11:
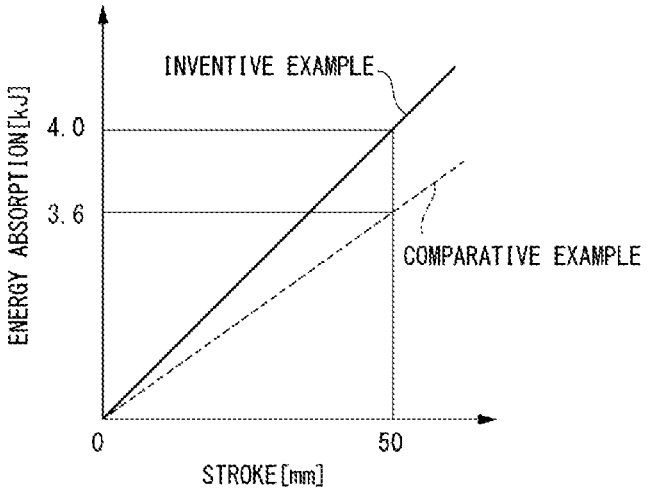
FIG. 11 is a graph comparatively illustrating results of energy absorption by a sample piece of the second embodiment of the present invention and a sample piece of correspondent Comparative Example under stroke of a falling weight test.
Figure 12:
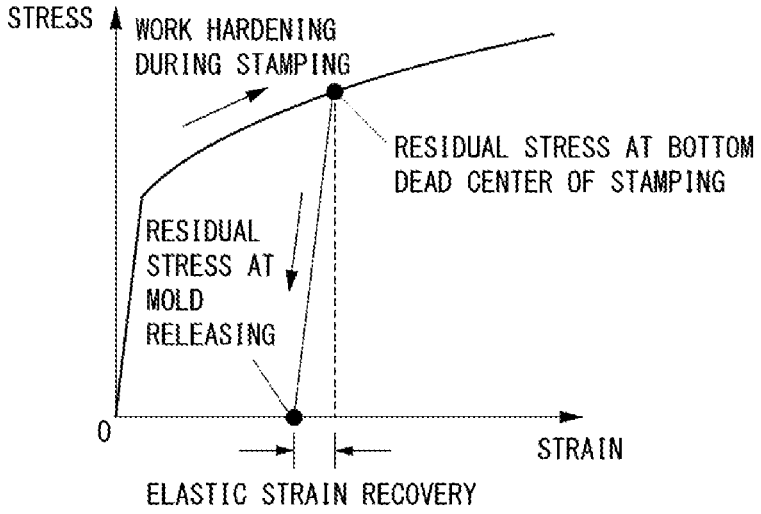
FIG. 12 is a drawing for explaining a generation mechanism of spring-back caused by elastic strain recovery.
Figure 13:
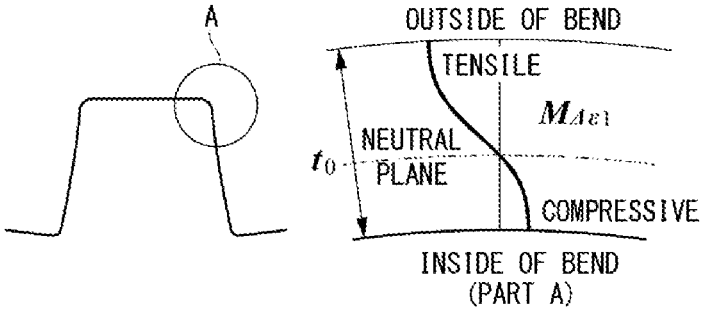
FIG. 13 is a drawing illustrating a relation between stress distribution in the thickness-wise direction of sheet before elastic recovery, and bending moment.
Figure 14:
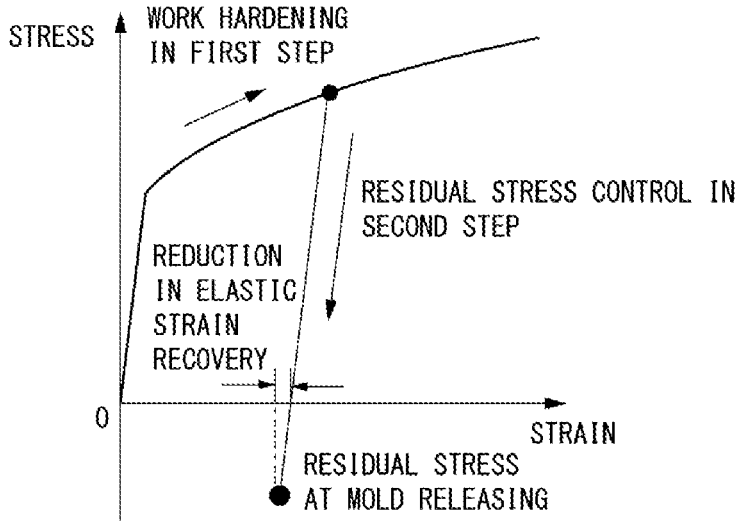
FIG. 14 is a drawing for explaining a mechanism of reduction in residual stress, by a countermeasure for shape fixability.

Results of energy absorption by the sample pieces according to Example of the present invention and Comparative Example, calculated by integrating the reaction force to deformation over stroke, are comparatively shown in FIG. 11.

As illustrated in FIG. 11, according to the present invention, the energy absorption by the component was found to increase by approximately 10% from 3.6 kJ to 4.0 kJ, by introducing a large work hardening into the steel sheet without decreasing the thickness.

In the first embodiment described above, the ridges formed in the intermediate molding 100B were exemplified by those formed at the angular parts between each of the vertical walls 100*b* and the ceiling 100*c*. The ridges are typically formed so as to continuously extend in the longitudinal direction of the intermediate molding 100B (in FIG. 6, the direction z of beam of the stamped product). A plurality of, or a plurality of lines of ridges may be formed in this case. The plurality of lines of ridges may suffice if they extend as a whole in the longitudinal direction of the intermediate molding 100B, even if each of them is formed in a fragmental, or discontinuous manner. For example, they may be aligned in a staggered manner as a whole.

INDUSTRIAL APPLICABILITY

According to the present invention, by means of the press forming method capable of enhancing deformation strength of a workpiece without annealing, and by using the workpiece after being molded by the press forming method, it is now possible to provide a vehicle component successfully enhanced in the rate of absorption of externally applied impact energy, and excellent in the crash safety performance. In this sort of industry, this successfully implements a vehicle body which is excellent both in reduction of $CO_2$ emission and vehicle safety performance.

The invention claimed is:

1. A press forming method press forming a workpiece between a die and a punch, while pushing the punch into the die by means of a relative motion of the die and the punch, the method comprising:

producing an intermediate molding having a ridge formed in a predetermined part of the workpiece, wherein the ridge is formed on a ceiling between vertical walls of the intermediate molding of the workpiece; and press forming the intermediate molding into a final shape in order to flatten and thicken the predetermined part having the ridge formed therein, to thereby thicken and work-harden the predetermined part of the workpiece and to thin and work-harden the vertical walls.

2. The press forming method of claim 1, comprising:

producing the intermediate molding having the ridge provided in the workpiece, and then press forming the intermediate molding to thereby flatten the predetermined part having the ridge provided therein between the die and the punch.

3. The press forming method of claim 1, comprising:

producing the intermediate molding having the ridge provided in the workpiece, after or at the same time with press forming of the workpiece, and then press forming the intermediate molding to thereby flatten the predetermined part having the ridge provided therein between the die and the punch.

4. The press forming method of claim 1, wherein the intermediate molding, produced from the workpiece so as to have an intermediate shape with a section line length 2% or more larger than a section line length of the final shape, is stamped once or more, to thereby shape the workpiece into the final shape.

5. The press forming method of claim 1, wherein a ridge is also formed on an angular part of the intermediate molding of the workpiece.

* * * * *